United States Patent [19]

Ito et al.

[11] Patent Number: 4,696,278

[45] Date of Patent: Sep. 29, 1987

[54] METHOD AND DEVICE FOR CONTROL OF INTERNAL COMBUSTION ENGINE AT END OF FUEL CUT OFF

[75] Inventors: Toshimitsu Ito; Chigaku Murata, both of Toyota, Japan

[73] Assignee: Toyota Jidosha Kabushiki Kaisha, Toyota, Japan

[21] Appl. No.: 830,879

[22] Filed: Feb. 19, 1986

[30] Foreign Application Priority Data

Feb. 20, 1985 [JP] Japan ..... 60-31934

[51] Int. Cl.[4] ..... F02D 41/12

[52] U.S. Cl. ..... 123/493; 123/326; 123/527

[58] Field of Search ..... 123/478, 488, 493, 325, 123/326, 527

[56] References Cited

U.S. PATENT DOCUMENTS

| | | | |
|---|---|---|---|
| 4,240,390 | 12/1980 | Takeda | 123/480 |
| 4,430,978 | 2/1984 | Lewis et al. | 123/478 |
| 4,452,212 | 6/1984 | Takase | 123/326 X |
| 4,462,375 | 7/1984 | Isobe et al. | 123/488 X |
| 4,489,696 | 12/1984 | Kobayashi et al. | 123/493 |
| 4,499,879 | 2/1985 | Stoltman et al. | 123/478 X |
| 4,527,521 | 7/1985 | Hasegawa et al. | 123/326 |

FOREIGN PATENT DOCUMENTS

| | | | |
|---|---|---|---|
| 200632 | 12/1982 | Japan | 123/493 |
| 203827 | 11/1984 | Japan | 123/326 |
| 60-49 | 1/1985 | Japan | 123/326 |

*Primary Examiner*—Tony M. Argenbright

*Attorney, Agent, or Firm*—Cushman, Darby & Cushman

[57] ABSTRACT

In the fuel control for an engine for which cut off of fuel supply is performed while the engine is in the decelerating operation condition, at the time of fuel cut off termination, an injection of fuel through a fuel injector into an intake system of the engine is supplied at substantially the same time as stopping the fuel cut off, wherein the amount of such fuel injection is controlled according to the temperature of the air being sucked into the engine intake system so as to be decreased as the air temperature increases.

8 Claims, 3 Drawing Figures

METHOD AND DEVICE FOR CONTROL OF INTERNAL COMBUSTION ENGINE AT END OF FUEL CUT OFF

BACKGROUND OF THE INVENTION

The present invention relates to a method of controlling fuel supply to an internal combustion engine at the time of termination of fuel cut off therefor.

When the vehicle incorporating an internal combustion engine is being decelerated, in order to decrease the amount of uncombusted components in the exhaust gas of the engine, and in order to conserve fuel, it is per se conventional to cut off the supply of fuel to the engine. Such a fuel cut off procedure is starterd, typically, when the throttle valve of the engine is set to the idling position but the engine rotational speed is greater than a certain determinate value, which indicates that the engine is not currently idling. Further, such a fuel cut off procedure is terminated, typically, when the throttle valve of the engine is opened from said idling position, or when the engine rotational speed drops below said certain determinate value. It is not acceptable to have any substantial delay in restoring the supply of fuel at the ending of fuel cut off, because in such a case the engine will quite probably stall. In Japanese Laid Open Publications Nos. 55-49537 (1980) and 58-162740 (1983), both of which relate to the electronic fuel injection type fuel supply means for internal combustion engines, it is proposed that, at the same instant as indication of fuel cut off stops, the fuel injector provides an injection of fuel, so that no substantial delays of fuel supply arise.

However, it is not always satisfactory that a constant amount of fuel is injected at the end of fuel cut off as proposed in the prior art. Specifically, the colder the intake air which is being sucked into the engine, the easier it is for the engine to stall; and further, the colder the intake air, the greater is its density, so that more fuel is required in order to provide the correct air/fuel ratio for combustion. Now, since the prior art outlined above has provided a substantially fixed amount of fuel at the end of fuel cut off, this has meant that in some circumstances either too much or too little fuel has been supplied for proper engine operation, and stalling of the engine has thus not been positively prevented. As a consequence of the above problem, the engine revolution speed at the end of fuel cut off has been required to be set higher than would be otherwise desirable.

SUMMARY OF THE INVENTION

Accordingly, it has been conceived of by the present inventive entity that it is desirable for the amount of fuel at the end of fuel cut off to be made to depend upon the temperature of the air being sucked into the engine.

Accordingly, it is the primary object of the present invention to provide a method and a device for fuel control for an engine at end of fuel cut off, which avoid the above outlined problems.

It is a further object of the present invention to provide such a method and a device for fuel control for an engine at end of fuel cut off, which positively ensure that the engine has no tendency to stall at this time.

It is a further object of the present invention to provide such a method and a device for fuel control for an engine at end of fuel cut off, which ensure that the right amount of fuel is provided in all operational circumstances at this time.

It is a further object of the present invention to provide such a method and a device for fuel control for an engine at end of fuel cut off, which ensure that the engine is neither starved of fuel at this time, nor is flooded.

It is a further object of the present invention to provide such a method and a device for fuel control for an engine at end of fuel cut off, which allow the engine revolution speed at the end of fuel cut off to be set lower than was constrained to be the case in the prior art.

It is a further object of the present invention to provide such a method and a device for fuel control for an engine at end of fuel cut off, which aid with the conservation of fuel.

It is a further object of the present invention to provide such a method and a device for fuel control for an engine at end of fuel cut off, which promote the good quality of the exhaust gases of the engine.

It is a further object of the present invention to provide such a method and a device for fuel control for an engine at end of fuel cut off, which allow the engine to be set to have better idling characteristics.

It is yet further object of the present invention to provide a device for fuel control for an engine at end of fuel cut off, which aid with the achievement of the above identified objects relating to a method.

According to the most general method aspect of the present invention, these and other objects are accomplished by a method for fuel control for an engine for which cut off of fuel supply is performed while the engine is in a decelerating operational condition, comprising the step of, at the time of fuel cut off termination, supplying an injection of fuel through a fuel injector into an intake system of said engine at substantially the same time as stopping the fuel cut off, wherein the amount of such fuel injection is controlled according to the temperature of the air being sucked into said engine intake system, so as to be decreased as said air temperature increases; and, according to the most general device aspect of the present invention, these and other objects are accomplished by a device for fuel control for an engine comprising an intake system and a fuel injector fitted therein, comprising: (a) a means for cutting off fuel supply while the engine is in the decelerating operational condition; (b) a means for, at the time of fuel cut off termination, supplying an injection of fuel through said fuel injector into said intake system of said engine at substantially the same time as the fuel cut off is stopped; and (c) a means for controlling the amount of such fuel injection at the time of fuel cut off termination according to the temperature of the air being sucked into said intake system of said engine, so as to be decreased as said air temperature increases.

According to such a method and such a device, whatever may be the intake air temperature, always an appropriate amount of fuel injection at the end of fuel cut off is performed. Thus, there are provided a method and a device for fuel control for an engine at end of fuel cut off, which positively ensure that the engine has no tendency to stall at this time, and which ensure that the right amount of fuel is provided in all operational circumstances at this time, thereby ensuring that the engine is neither starved of fuel at this time, nor is flooded. Accordingly, it becomes possible to allow the engine revolution speed at the end of fuel cut off to be set lower than was constrained to be the case in the prior art. This is a very significant benefit of the present invention, because it allows conservation of fuel and reduction of exhaust pollutants, as well as better idling characteristics of the engine.

BRIEF DESCRIPTION OF THE DRAWINGS

The present invention will now be shown and described with reference to a preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Figure 1:
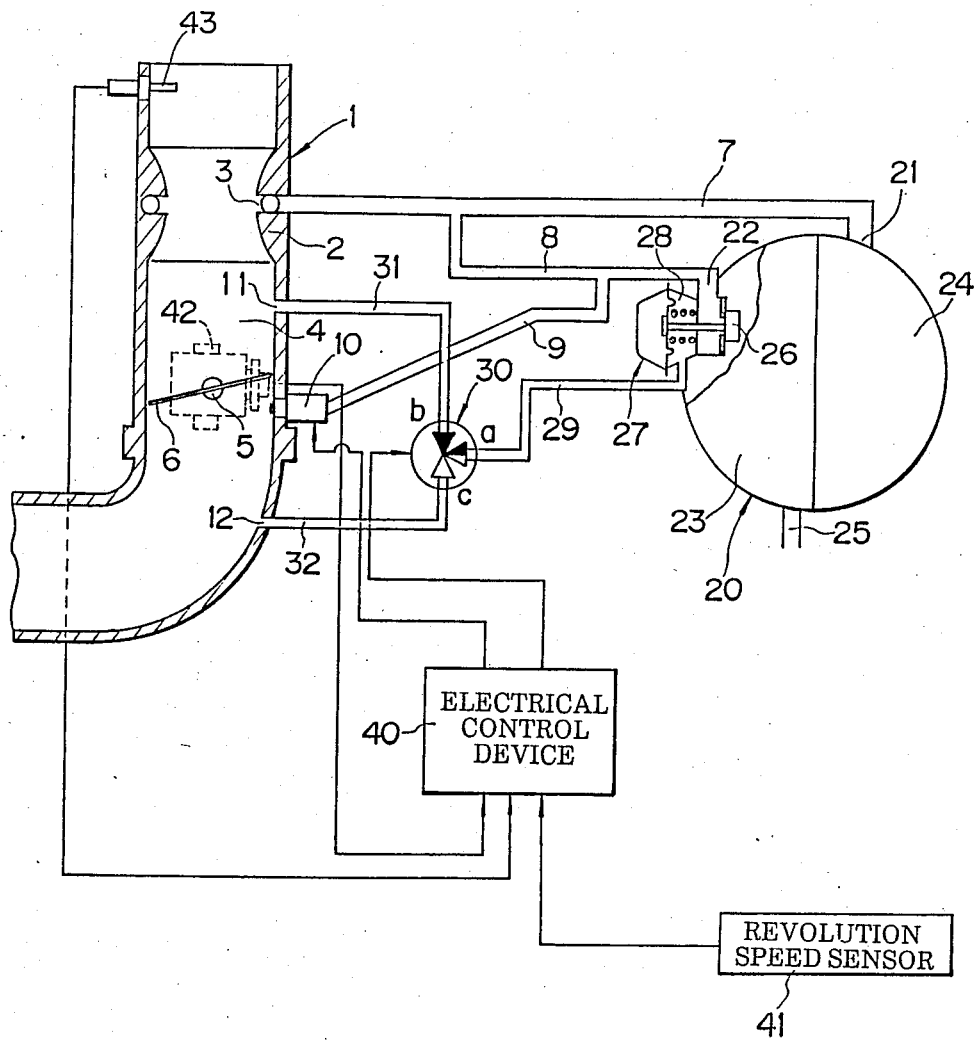
FIG. 1 is a schematic overall view of the preferred embodiment of the fuel injection control device of the present invention, which practices the preferred method embodiment and is shown in part block diagrammatical form, and further shows in longitudinal sectional view part of the intake system of an internal combustion engine to which said present invention is applied.

Referring to FIG. 1, the reference numeral 1 generally designates an intake system of an internal combustion engine, not shown in the figure, which in this preferred embodiment is an engine of a type fueled by liquid petroleum gas (LPG), although this is not intended to be limitative of the present invention. This intake system 1 has a venturi portion 2, and a main fuel port 3 opens into said venturi portion 2 approximately at the narrowest portion thereof. The engine (not shown) is connected to an intake passage 4 of the intake system 1 at its lower and leftmost portion as viewed in FIG. 1, and downstream of the venturi portion 2, between it and said engine, there is provided in said intake passage 4 a throttle valve 6 of the butterfly type, as rotatably mounted supported by a throttle valve shaft 5. In the shown preferred embodiment, the throttle valve 6 does not completely close the intake passage 4 even when it is in the idling position as shown in FIG. 1, so as to allow a small amount of LPG supplied to the main fuel port 3 in idling operation of the engine to flow toward the engine cylinders.

An LPG regulator valve 20 is of a per se known type, and has a primary pressure reduction chamber 23 and a secondary pressure reduction chamber 24. Liquid petroleum gas (LPG) is supplied from a tank (not shown) through a fuel inlet port 25 into the primary pressure reduction chamber 23, and undergoes a primary pressure reduction therein to a pressure somewhat over atmospheric pressure. Then further some of this LPG is supplied from said primary pressure reduction chamber 23 to a secondary pressure reduction chamber 24, with its pressure being further reduced to become substantially equal to atmospheric pressure.

The primary pressure reduction chambr 23 is open to a slow fuel take out port 22, and the secondary pressure reduction chamber 24 is open to a main fuel take out port 21. The main fuel take out port 21 is connected via a main fuel line 7 to the main fuel port 3 opening in the venturi portion 2, and the slow fuel take out port 22 is also connected via a slow fuel line 8 to said main fuel port 3. The opening and closing of the slow fuel take out port 22 is controlled by a slow lock valve 26 which incorporates a slow lock diaphragm device 27 which incorporates a diaphragm chamber 28. When a vacuum (manifold vacuum) of pressure value lower than ambient atmospheric pressure by equal to or more than a determinate value is supplied to said diaphragm chamber 28, the diaphragm device 27 moves a valve element so as to open the slow fuel take out port 22; but, on the other hand, when no such considerable vacuum is supplied to said diaphragm chamber 28, said diaphragm device 27 moves said valve element so as to close said slow fuel take out port 22.

This diaphragm chamber 28 is connected via a vacuum conduit 29 with a port designated as "a" of an electromagnetic vacuum switching valve 30. A second port designated as "b" of said valve 30 is connected via another vacuum conduit 31 with a first vacuum take out port 11 which opens to the intake passage 4 to be always upstream of the throttle valve 6. And a third port designated as "c" of said electromagnetic vacuum switching valve 30 is connected via another vacuum conduit 32 with a second vacuum take out port 12 which opens to said intake passage 4 to be always downstream of said throttle valve 6. When actuating electrical energy is supplied to a solenoid or the like (not particularly shown) of said electromagnetic vacuum switching valve 30, its port "a" is communicated with its port "b" while it is isolated from its port "c", and, in this state of the apparatus, particularly when the engine is in idling or accelerating condition, with the throttle valve 6 being closed as shown in FIG. 1, no substantial vacuum is supplied to the first vacuum take out port 11, and therefore the slow fuel take out port 22 is closed by the slow lock valve 26 so as not to supply any LPG in the primary pressure reduction chamber 23 to the main fuel port 3. On the other hand, when no such actuating electrical energy is supplied to said solenoid or the like of said electromagnetic vacuum switching valve 30, its port "a" is communicated with its port "c" while it is isolated from its port "b", and in this state of the apparatus, particularly when the engine is in the idling or decelerating condition with the throttle valve 6 being closed as shown in FIG. 1, a substantial manifold vacuum is supplied from the second vacuum take out port 12 to the diaphragm chamber 28 of the slow lock valve 26, and thus said slow lock valve 26 definitely opens the slow fuel take out port 22 and allows LPG in the primary pressure reduction chamber 23 to be supplied to the main fuel port 3. And selective supply of actuating electrical energy to said solenoid or the like of the electromagnetic vacuum switching valve 30 is performed by an electrical control device 40, which further selectively supplies actuating electrical energy to a fuel injector valve 10 provided in the intake passage 4 of the engine just downstream of the throttle valve 6; this fuel injector valve 10 is supplied with LPG at its inlet via a fuel line 9 which branches off from the fuel line 8.

This electrical control device 40 includes a microcomputer which operates according to a control program implanted therein. And this microcomputer receives as inputs: information relating to the revolution speed of the engine from an engine revolution speed sensor 41, information relating to the amount of opening of the throttle valve 6 from a throttle valve opening amount sensor 42 mounted to the throttle shaft 5, and information relating to the temperature of the air which is being sucked into the intake system 1 of the engine from an intake air temperature sensor 43 mounted in said intake system 1 upstream of the venturi portion 2. When the engine revolution speed, as indicated by the engine revolution speed sensor 41, is greater than a determinate value, and further the throttle valve 6, as indicated by the throttle valve opening amount sensor 42, is in the idling closed position, the electromagnetic vacuum switching valve 30 is energized by the electrical control device 40, so as to perform deceleration fuel cut off; and, when said electromagnetic vacuum switching valve 30 is deenergized for the end of fuel cut off, at substantially the same time an injection signal is dispatched by the electrical control device 40 to turn the fuel injector 10 on for a period determined by the temperature of the air which is being sucked into the intake system 1 of the engine, as determined by the intake air temperature sensor 43.

Figure 2:
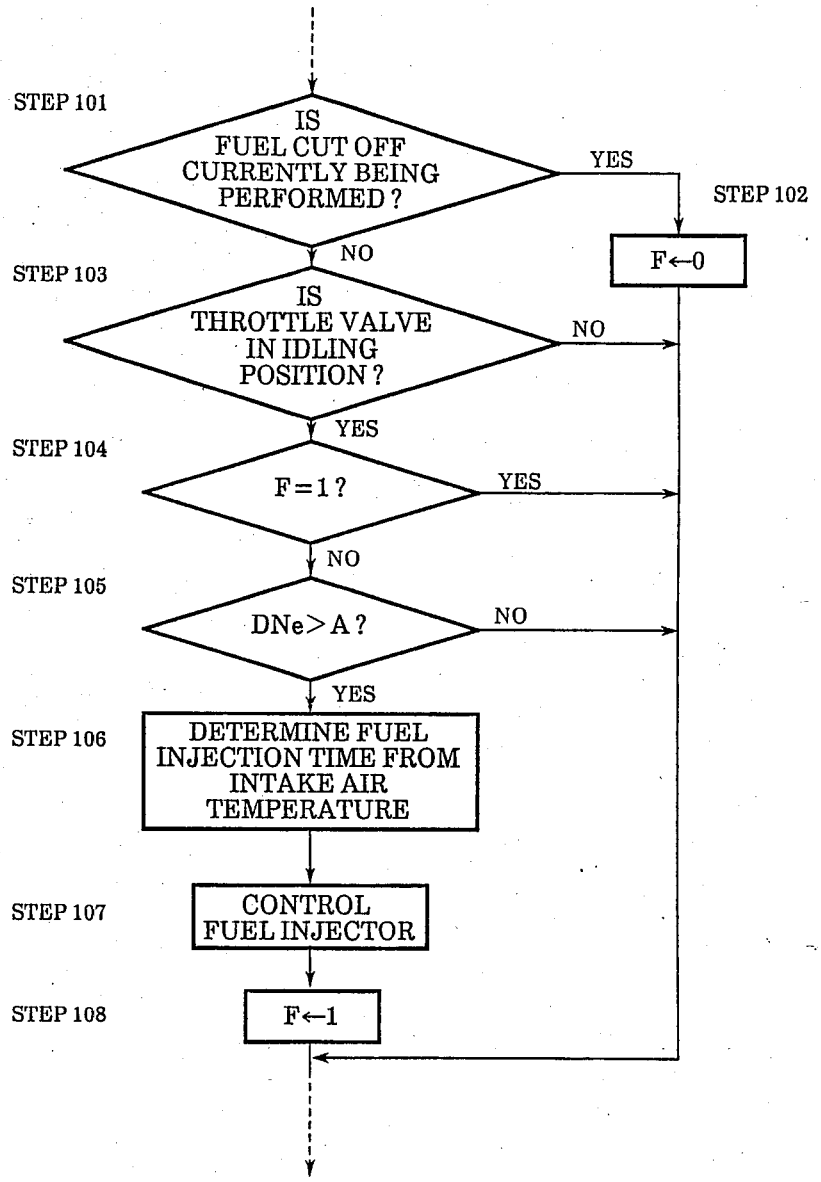
FIG. 2 is a flow chart for explanation of part of the action of a control program for a microcomputer incorporated in said preferred embodiment control system.

In FIG. 2, there is shown a flow chart for aiding in the explanation of the action of the part of the control program for this microcomputer incorporated in the electrical control device 40 which deals with the ending of fuel cut off. This portion of said control program is incorporated in a main routine for said microcomputer.

First, in the step 101, a judgement is made as to whether or not fuel cut off control is currently being performed, i.e. as to whether the electromagnetic vacuum switching valve 30 is currently being energized for the fuel cutting off, or not. If the answer is YES, i.e. currently said electromagnetic vacuum switching valve 30 is being energized, then the flow of control passes to the step 102; but, if the answer to this judgement is NO, then the flow of control passes to the step 103.

In the step 102, the value of a flag F is set to zero, and then the flow of control passes to exit this program portion, without doing anything further. On the other hand, in the step 103, a judgement is made as to whether or not the throttle valve 6 is currently in idling position, or not; this judgement is made based upon the current value of the output from the throttle valve opening amount sensor 42. If the answer is YES, i.e. currently the throttle valve 6 of the engine is in the idling position, then the flow of control passes to the step 104; but if the answer is NO, then the flow of control passes to exit this program portion, without doing anything further.

In the step 104, a judgement is made as to whether or not the value of the flag F is currently unity, or not. If the answer is YES, then the flow of control passes to exit this program portion, without doing anything further. On the other hand, if the answer is NO, then the flow of control passes to the step 105.

In the step 105, a judgement is made as to whether or not a value DNe representative of the rate of reduction of the revolution speed of the engine, as determined from the output of the engine revolution speed sensor 41, is greater than a determinate value A, or not. If the answer is NO, then the flow of control passes to exit this program portion, without doing anything further; while, if the answer is YES, then the flow of control passes to the step 106.

Figure 3:
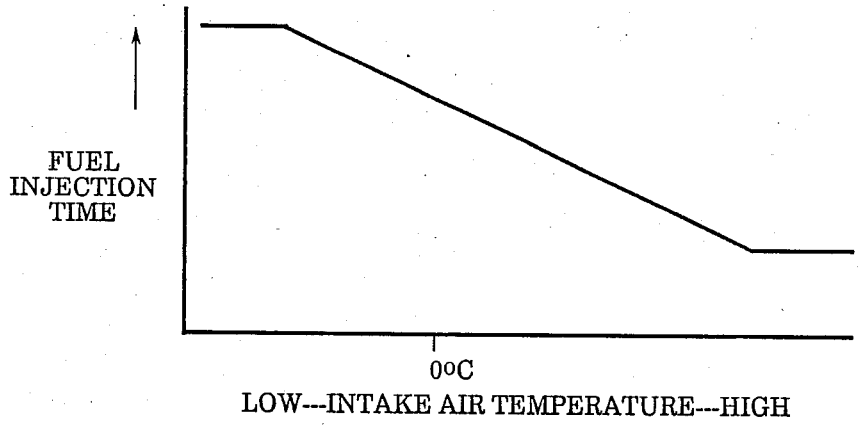
FIG. 3 is a graph, in which intake air temperature is shown along the horizontal axis and fuel injection time is shown along the vertical axis, for explaining the principle of the present invention.

In the step 106, the length of the time for fuel injection through the fuel injection valve 10 is determined according to the current value of the temperature of the air which is being sucked into the intake system 1 of the engine, as determined by the intake air temperature sensor 43, as per the characteristics shown in FIG. 3: in other words, the higher is the intake air temperature within a certain range, the lower is the fuel injection time, and outside this range on either side thereof the fuel injection time is substantially constant. Then the flow of control passes to the step 107.

In the step 107, a signal is outputted to the fuel injector 10 to open it for the length of time decided in the step 106. During this open period, LPG flows through the fuel line 9 to the fuel injector 10 and therethrough into the intake system 1 and to the engine at a substantially constant rate. Thus an appropriate injection of fuel is obtained in these engine operational circumstances, according to the temperature of the air which is being sucked in.

In the final step 108, to which the flow of control passes after the step 107, the value of the flag F is set to 1, so as to avoid performing this fuel injection procedure more than once; and then the flow of control passes to exit this program portion.

Thus, it is seen that according to the present invention an appropriate amount of fuel injection at the end of fuel cut off is performed over a wide range of intake air temperature. Thus, it is seen that there are provided a method and a device for fuel control for an engine at the end of fuel cut off, which positively ensure that the engine has no tendency to stall at this time, and which ensure that the right amount of fuel is provided in all operational circumstances at this time, thereby ensuring that the engine is neither starved of fuel at this time, nor is flooded. Accordingly, it becomes possible to allow the engine revolution speed at the end of fuel cut off to be set lower than was constrained to be the case in the prior art, and this is a very significant benefit of the present invention, because it allows conservation of fuel and reduction of exhaust pollutants, as well as better idling characteristics of the engine.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, although the present invention has been shown and described in terms of a liquid petroleum gas type internal combustion engine, in fact it will be easily understood that it is applicable, in another embodiment thereof, to a gasoline engine, mutatis mutandis. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. A method of fuel control for an engine for which cut off of fuel supply is performed while the engine is in a decelerating operational condition, comprising the steps of, at the time of fuel cut off termination, judging whether the rate of reduction of the revolution speed of the engine is greater than a predetermined value or not, and supplying a temporary injection of fuel through an auxiliary fuel injector into an intake system of said engine at substantially the same time as stopping the fuel cut off only when the rate of reduction of the revolution speed of the engine is greater than said predetermined value, wherein the amount of the temporary fuel injection is controlled according to the temperature of the air being sucked into said engine intake system so as to be decreased as said air temperature increases at least within a predetermined range of said air temperature.

2. A method for fuel control according to claim 1, wherein said amount of fuel injection at the end of fuel cut off is substantially constant with increasing intake air temperature until said intake air temperature reaches a first determinate value, thereafter decreases with increase of said intake air temperature until said intake air temperature reaches a second determinate value, and thereafter is substantially constant as said intake air temperature increases beyond said second determinate value.

3. A method for fuel control according to claim 2, wherein said decrease of amount of fuel injection at the end of fuel cut off with increase of intake air temperature between said first and said second determinate values follows a substantially linear relation.

4. A method for fuel control according to claim 2, wherein said first and said second determinate values of intake air temperature straddle the value of 0° C.

5. A device for fuel control for an engine comprising an intake system and a main and an auxiliary fuel injector fitted therein, comprising:

(a) a means for cutting off fuel supply while the engine is in a decelerating operational condition;

(b) a means for, at least at the time of fuel cut off termination, judging whether the rate of reduction of the revolution speed of the engine is greater than a predetermined value or not;

(c) a means for, at the time of fuel cut off termination, supplying a temporary injection of fuel through said auxiliary fuel injector into said intake system of said engine at substantially the same time as the fuel cut off is stopped only when the rate of reduction of the revolution speed of the engine is judged by said means for judging the rate of reduction of the revolution speed of the engine to be greater than said predetermined value; and (d) a means for controlling the amount of the temporary fuel injection at the time of fuel cut off termination according to the temperature of the air being sucked into said intake system of said engine, so as to be decreased as said air temperature increases at least within a predetermined range of said air temperature.

6. A device for fuel control according to claim 5, wherein said means for controlling the amount of such fuel injection at the time of fuel cut off termination keeps said fuel injection amount substantially constant with increasing intake air temperature until said intake air temperature reaches a first determinate value, thereafter decreases said fuel injection amount with increase of said intake air temperature until said intake air temperature reaches a second determinate value, and thereafter keeps said fuel injection amount substantially constant as said intake air temperature increases beyond said second determinate value.

7. A device for fuel control according to claim 6, wherein said decrease of said cut off end fuel injection amount with increase of intake air temperature between said first and said second determinate values is controlled by said means for controlling the amount of such fuel injection at the time of fuel cut off termination to follow a substantially linear relation.

8. A device for fuel control according to claim 6, wherein said first and said second determinate values of intake air temperature straddle the value of 0° C.

* * * * *